US009060553B2

(12) United States Patent
Crye

(10) Patent No.: US 9,060,553 B2
(45) Date of Patent: Jun. 23, 2015

(54) STOWABLE JACKET

(75) Inventor: Caleb Clark Crye, Brooklyn, NY (US)

(73) Assignee: LineWeight LLC, Brooklyn, NY (US)

( * ) Notice: Subject to any disclaimer, the term of this patent is extended or adjusted under 35 U.S.C. 154(b) by 109 days.

(21) Appl. No.: 13/238,299

(22) Filed: Sep. 21, 2011

(65) Prior Publication Data

US 2013/0067631 A1 Mar. 21, 2013

(51) Int. Cl.

*A41D 1/02* (2006.01)
*A41D 15/00* (2006.01)
*A41D 3/00* (2006.01)

(52) U.S. Cl.

CPC ..... *A41D 15/007* (2013.01); *A41D 2400/422* (2013.01); *A41D 2400/44* (2013.01); *A41D 3/00* (2013.01); *A41D 2400/48* (2013.01)

(58) Field of Classification Search

USPC ..... 2/69, 108, 220, 93, 102
See application file for complete search history.

(56) References Cited

U.S. PATENT DOCUMENTS 1,421,131 A 6/1922 Abrams
2,202,341 A * 5/1940 Fisher ..... 2/90
2,361,380 A 10/1944 Callahan
2,751,596 A 6/1956 Bagaloff
4,048,675 A * 9/1977 Griffin ..... 2/93
4,343,046 A 8/1982 Zebell
4,347,629 A 9/1982 Itoi
4,554,682 A * 11/1985 Hillquist ..... 2/70
5,010,592 A 4/1991 Skiles, Jr.
5,077,838 A 1/1992 Senser
5,309,572 A * 5/1994 Seamans ..... 2/112
5,628,064 A * 5/1997 Chung ..... 2/70
5,978,961 A 11/1999 Barker
6,029,270 A 2/2000 Ost et al.
6,405,377 B1 * 6/2002 Davis ..... 2/94
7,028,342 B1 * 4/2006 Nordstrom et al. ..... 2/119
7,117,539 B1 10/2006 Baacke
7,284,282 B2 10/2007 Bay
7,343,629 B2 * 3/2008 Hunt ..... 2/93
7,374,071 B2 5/2008 Lavelle
7,770,234 B2 8/2010 Roux et al.
D655,894 S * 3/2012 Crye ..... D2/831
2004/0158910 A1 * 8/2004 Bay ..... 2/69
2004/0199976 A1 10/2004 Hunt
2005/0015843 A1 * 1/2005 Roux et al. ..... 2/69
2005/0044605 A1 * 3/2005 Hofmann ..... 2/69
2006/0236440 A1 10/2006 Zahler
2007/0277283 A1 * 12/2007 Borowski et al. ..... 2/69
2008/0005825 A1 1/2008 Tronvold (Continued)

OTHER PUBLICATIONS

International Search Report for PCT Application No. PCT/US2012/055712 mailed Nov. 27, 2012.

(Continued)

*Primary Examiner* — Shaun R Hurley
*Assistant Examiner* — Andrew W Sutton
(74) *Attorney, Agent, or Firm* — Merchant & Gould, P.C.

(57) ABSTRACT

A stowable outerwear garment is provided. The outerwear garment includes a shortened torso portion that deploys from an integral pouch to provide protection to a wearer's upper torso when worn in combination with a load-bearing vest. The shortened torso portion can include an elastic band extending about the wearer's torso and a plurality of fasteners supported by the elastic band to detachably secure the garment to the load-bearing vest. Sleeves can extend from the torso portion and can include an outer waterproof shell, an inner lining and an insulating material therebetween.

15 Claims, 6 Drawing Sheets

(56) References Cited

U.S. PATENT DOCUMENTS

| | | | | |
|---|---|---|---|---|
| 2008/0040832 | A1* | 2/2008 | Bay | 2/93 |
| 2009/0265829 | A1 | 10/2009 | Gomes Seguin | |
| 2010/0212061 | A1 | 8/2010 | Luciano | |
| 2010/0320241 | A1* | 12/2010 | Thompson | 224/153 |
| 2011/0197332 | A1* | 8/2011 | Yu | 2/85 |
| 2011/0206299 | A1 | 8/2011 | Carmody | |
| 2012/0124713 | A1* | 5/2012 | Blauer et al. | 2/102 |
| 2012/0324612 | A1* | 12/2012 | Howell et al. | 2/2.5 |

OTHER PUBLICATIONS

Written Opinion of the International Searching Authority for PCT Application No. PCT/US2012/055712 mailed Nov. 27, 2012.

* cited by examiner

STOWABLE JACKET

BACKGROUND OF THE INVENTION

The present invention relates to outerwear, and more particularly to upper-body outerwear worn in combination with body armor, chest rigs and other similar articles.

Numerous types of upper-body outerwear are currently in use. Existing garments generally provide a degree of protection from moisture and extreme temperatures, while also allowing some degree of mobility to the wearer's arms. These garments are generally formed of lightweight, waterproof or water-resistant materials and generally include a degree of insulation and breathability. These garments can be relatively inexpensive, and are known to exhibit modest durability over repeated uses.

Despite their widespread acceptance, existing upper-body garments are in many instances poorly adapted for wear with load-bearing articles such as body armor, chest rigs and chest harnesses. For example, donning and doffing of the outerwear can include the removal and reapplication of body armor over the outerwear. While this process provides access to equipment supported by the body armor, it can be uncomfortable and time-consuming, while providing redundant protection to portions of the wearer. Donning of the outerwear over body armor is in many aspects an undesirable alternative, as the outerwear must generally be oversized to accommodate equipment supported by the wearer's torso and generally impedes access to the same.

SUMMARY OF THE INVENTION

An outerwear garment is provided. The garment includes a torso portion including a lower periphery extending about a wearer's torso and a plurality of fasteners supported by the lower periphery to detachably secure the garment to a load-bearing vest when worn by a user. The torso portion can further include an integral pocket for storing the garment in a folded condition. Sleeves can extend from the torso portion and can include an outer waterproof shell, an inner lining and an insulating material therebetween.

In one embodiment, the torso portion includes an elastic band extending along the lower periphery. The elastic band can include first and second end portions each including an anchor for tensioning the elastic band. The fasteners can include multiple clips supported by the elastic band at various locations along the lower periphery for attachment to corresponding fasteners in the load-bearing vest.

In another embodiment, the torso portion includes a back portion and a front portion cooperatively defining a neck opening and two arm openings. The front portion can include a vertical closure to facilitate donning and doffing of the garment. The back portion can include first and second partially overlapping panels to define a pocket for storing the garment in a folded condition. The garment may be deployed from the pouch for use as outerwear and inserted into the pocket for use as a pillow.

In still another embodiment, the torso portion terminates at a lower periphery above a wearer's abdomen. The torso portion can include a yoke extending between first and second arm openings and including an outer waterproof shell, an inner lining and an insulating material therebetween. The torso portion can further include a plurality of hook and loop connectors for attachment to various patches, insignia and equipment.

In even another embodiment, the torso portion is an upper torso portion, and the stowable jacket further includes a lower torso portion separable from the upper torso portion. The lower torso portion includes a lower periphery extending below the wearer's waist, and one or more fasteners detachably secure the lower torso portion to the upper torso portion. When separated from the lower torso portion, the upper torso portion can include a lower periphery that is cinchable at or above a wearer's abdomen. In addition, or alternatively, the upper torso portion can include one or more fasteners to detachably secure the upper torso portion to a load-bearing vest.

Embodiments of the invention can therefore provide added protection from rain, snow and blowing sand when worn in combination with a load-bearing vest or other article generally concealing the wearer's midsection. The outerwear garment can simultaneously maintain unobstructed access to radios, ammunition and additional equipment generally supported at the wearer's midsection or waist. When additional protection is no longer needed, the outerwear garment can be quickly removed and folded into a generally rectangular, pillow-like shape for storage in a rucksack or a cargo pocket.

These and other advantages and features of the invention will be more fully understood and appreciated by reference to the description of the current embodiments and the drawings.

DESCRIPTION OF THE CURRENT EMBODIMENTS

Figure 1:
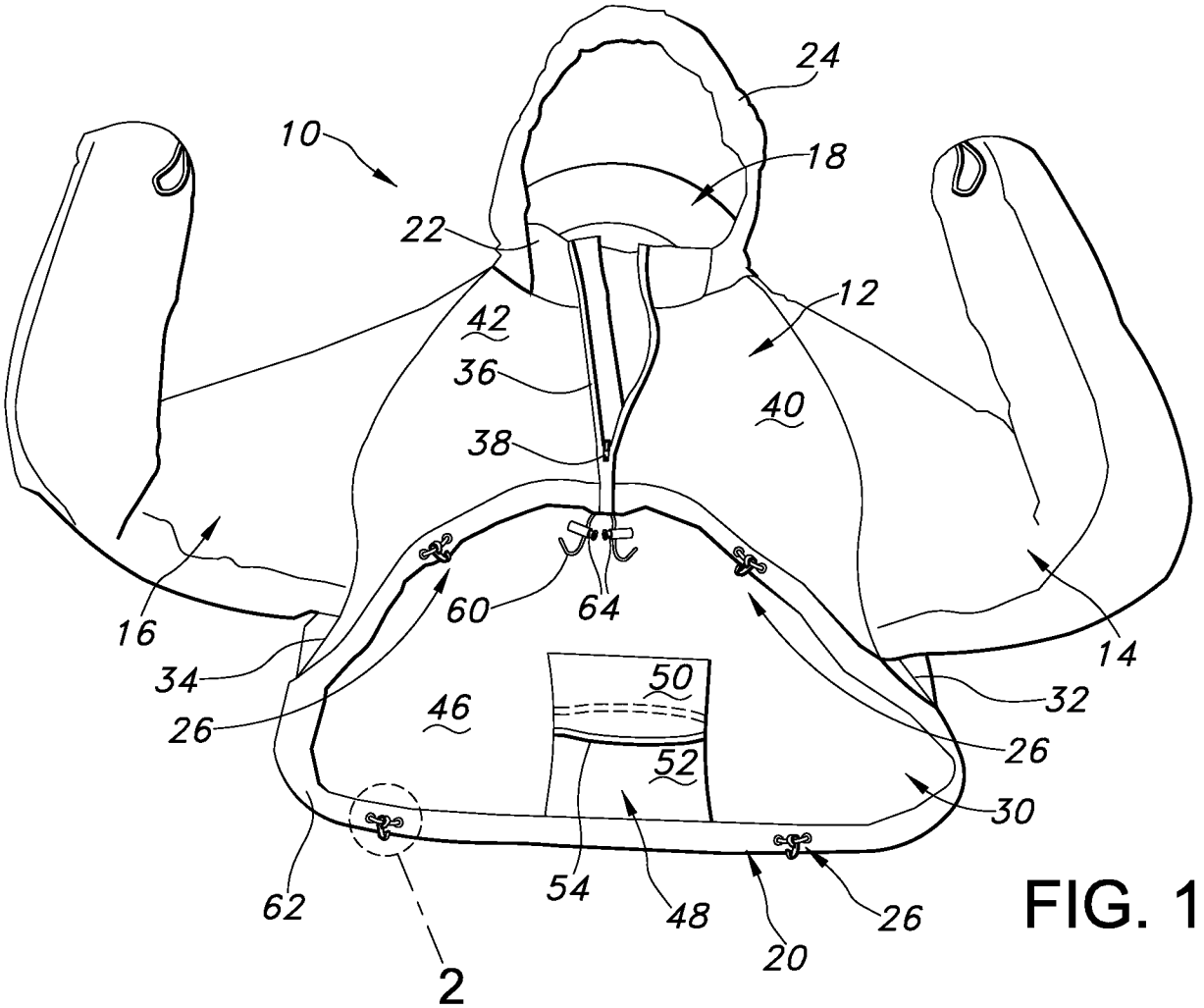
FIG. 1 is a perspective view of a stowable jacket.

A stowable jacket in accordance with an embodiment of the invention is illustrated in the drawings and generally designated 10. The stowable jacket 10 generally includes a shortened torso portion that deploys from an integral pouch to provide protection to a wearer's upper torso when worn in combination with a load-bearing vest.

With reference to FIG. 1, the stowable jacket 10 includes a torso portion 12 and left and right sleeves 14, 16. The torso portion 12 defines a neck opening 18 and a torso opening 20 spaced apart from the neck opening 18. The neck opening 18 can optionally include an upward extending collar 22 and a hood 24. The torso opening 20 can extend generally just at or above a wearer's abdomen and, as explained in more detail below, can include one or more fasteners 26 to join the stowable jacket 10 to a vest 100. The torso portion 12 further includes a front portion 28 and a back portion 30 joined along left and right seams 32, 34. The front portion 28 can define a generally vertical opening 36 including a closure 38 to releasably secure a left front panel 40 to a right front panel 42. In addition, the front and back portions 28, 30 can each define an outer surface 44 and an inner surface 46. The inner surface 46 of the back portion 30 can include a pouch 48 for storing the jacket 10 in a folded condition. The pouch 48 can include upper and lower partially overlapping panels 50, 52. Each panel 50, 52 can include an elastic trim 54 to retain the jacket 10 within the pouch 48 in a folded condition for storage.

Figure 2:
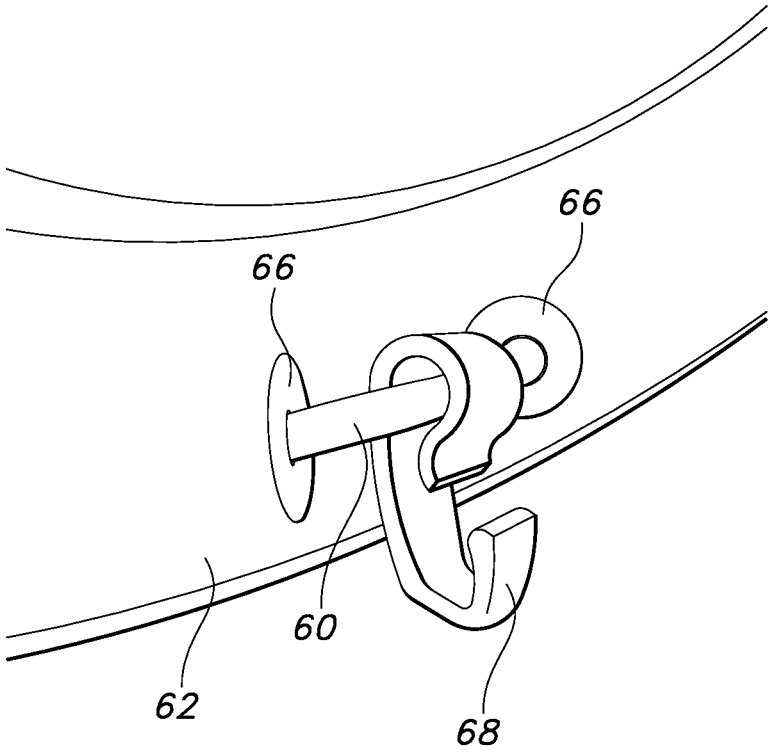
FIG. 2 is close-up view of the stowable jacket of FIG. 1 illustrating a fastener for attachment to a load-bearing vest.
Figure 3:
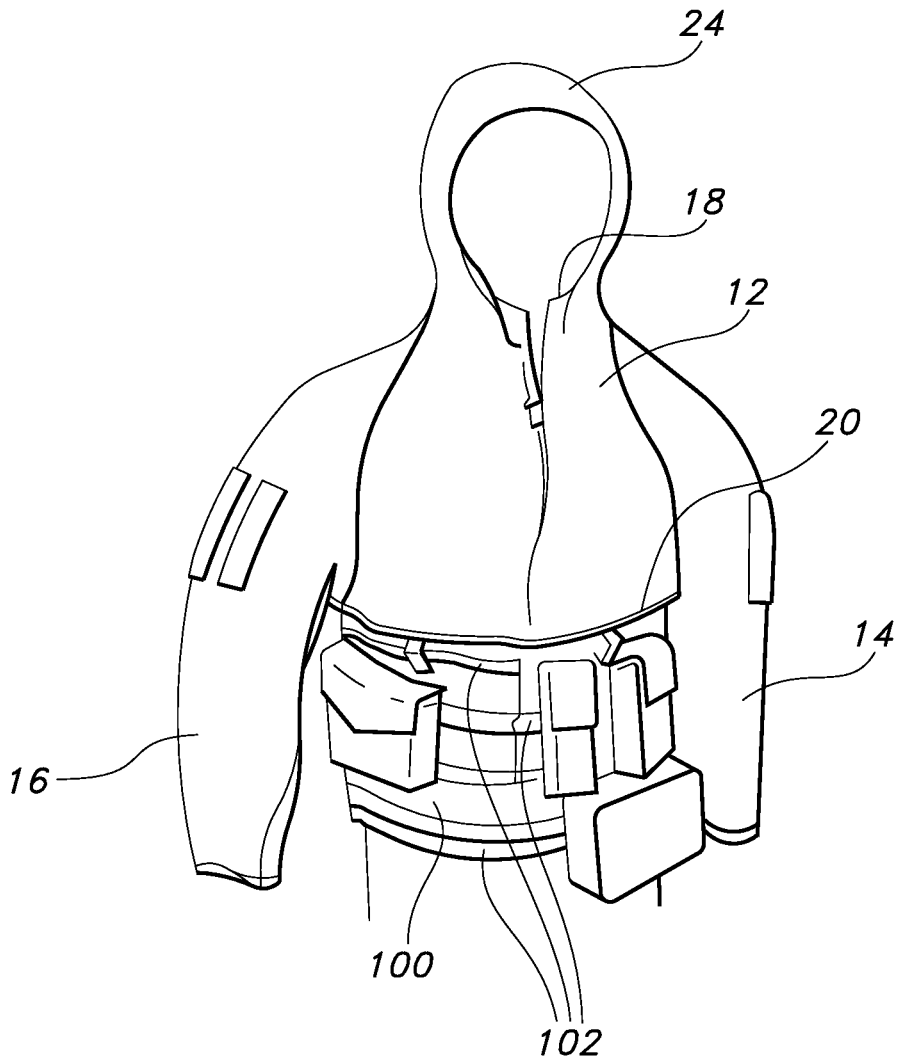
FIG. 3 is a perspective view of a stowable half jacket of FIG. 1 when worn with a load-bearing vest.

As noted above, the stowable jacket 10 includes a shortened torso portion 12 defining a torso opening 20 spaced apart from a neck opening 18. The torso opening 20 can include an elastic band 60 supported by the stowable jacket 10 through a transverse channel 62 in the lower periphery of the torso portion 12. The elastic band 60 can cinch the torso opening 20 about a wearer's torso and/or upper abdomen. The elastic band 60 can include one or more tensioning members or anchors 64 to retain a desired tension in the elastic band 60. The channel 62 can include a plurality of eyelets 66 to guide movement of the elastic band 60 and to expose portions of the elastic band 60 from within the channel 62. The exposed portions of the elastic band 60 can support respective fasteners 68 to removably engage a corresponding fastener in a separate article of clothing or equipment. As shown in FIG. 2, the fasteners 68 can include a curved clip for attachment to a transverse nylon web or other fastener. As shown in FIG. 3, for example, the jacket 10 can releasably attach to nylon webbing 102 on a load-bearing vest 100. In other embodiments, the fasteners 68, 102 can include hook and loop fasteners, while in other embodiments the fasteners 68, 102 can include one or more ties. In these configurations, the stowable jacket 10 can releasably attach to an upper portion of a load-bearing vest 100 for providing protection from cold and moisture to portions of the torso not otherwise protected by the load-bearing vest 100.

Figure 4:
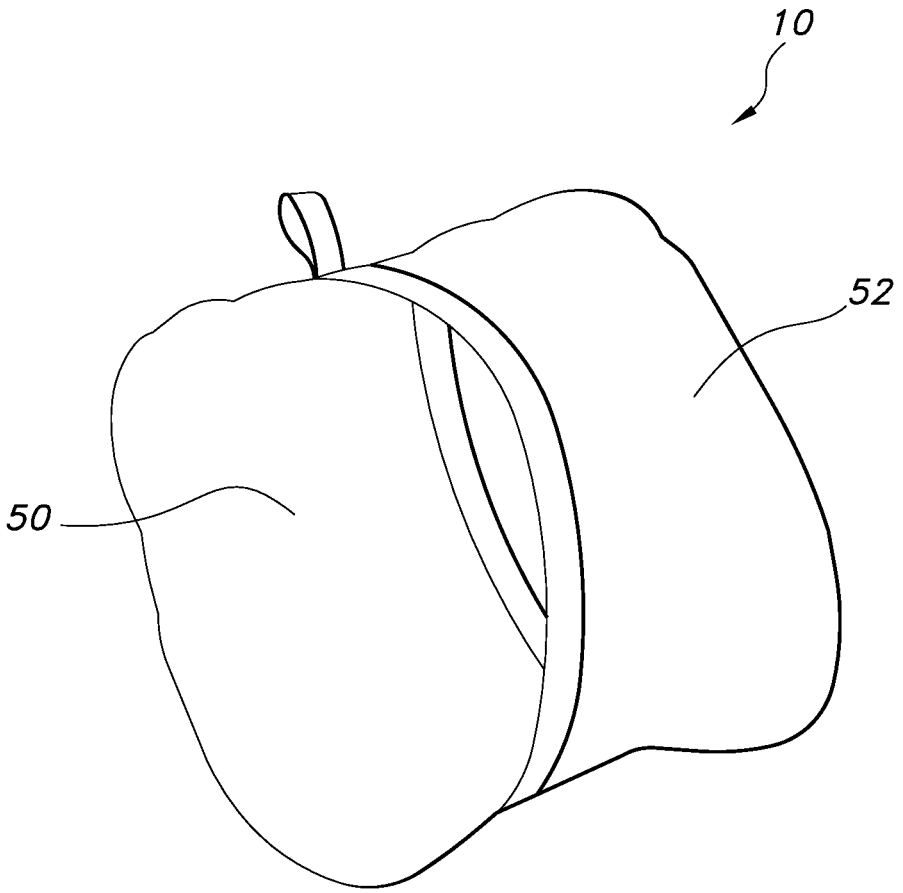
FIG. 4 is a perspective view of the stowable half jacket of FIG. 1 in a stowed configuration.
Figure 5:
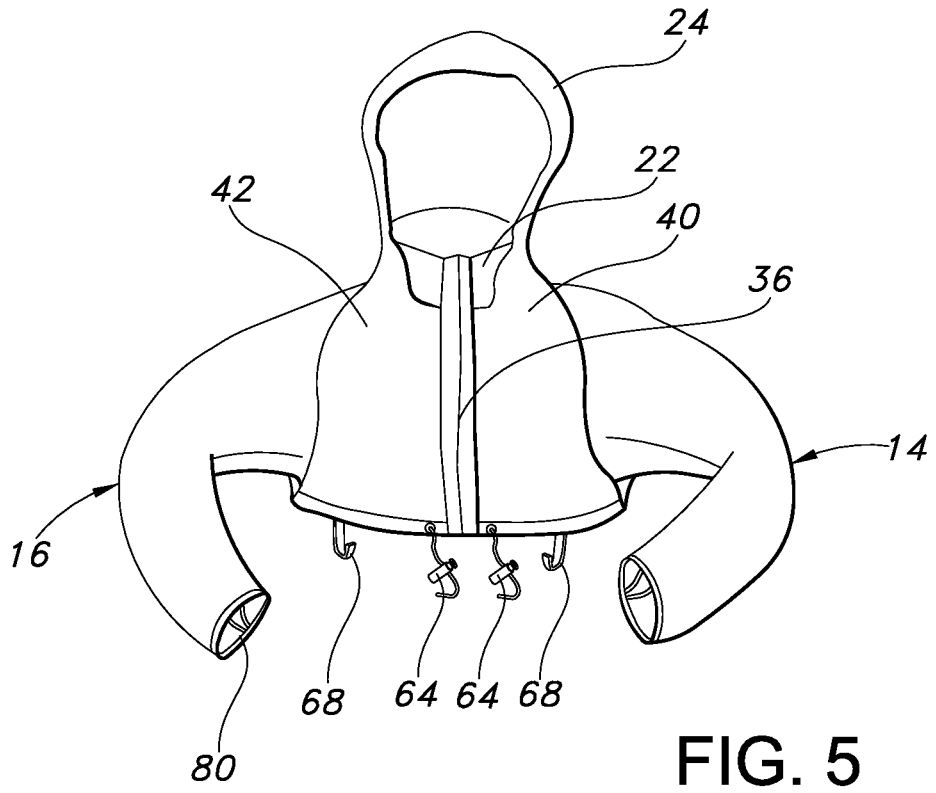
FIG. 5 is a front plan view of the stowable half jacket of FIG. 1.
Figure 6:
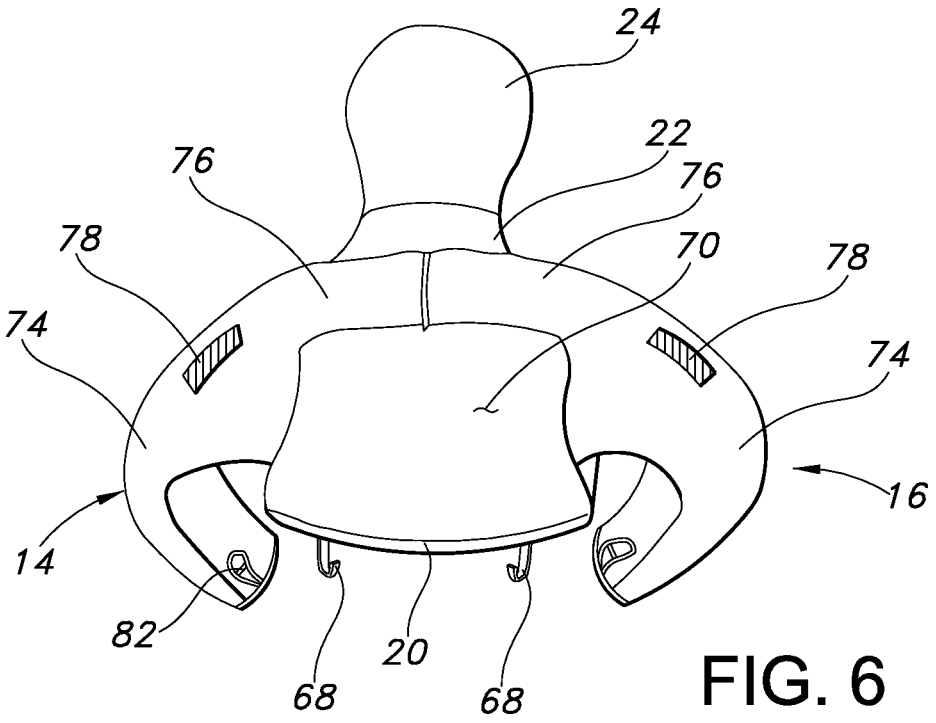
FIG. 6 is a rear plan view of the stowable half jacket of FIG. 1.
Figure 7:
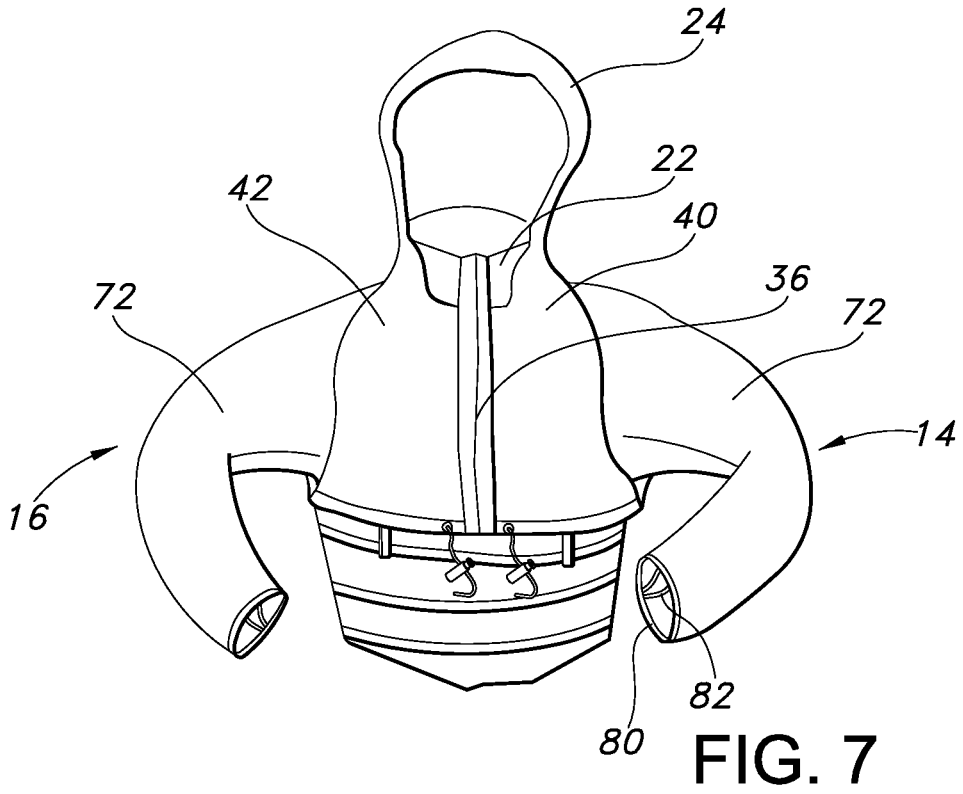
FIG. 7 is a front plan view of the stowable half jacket of FIG. 1 joined to a load-bearing vest.
Figure 8:
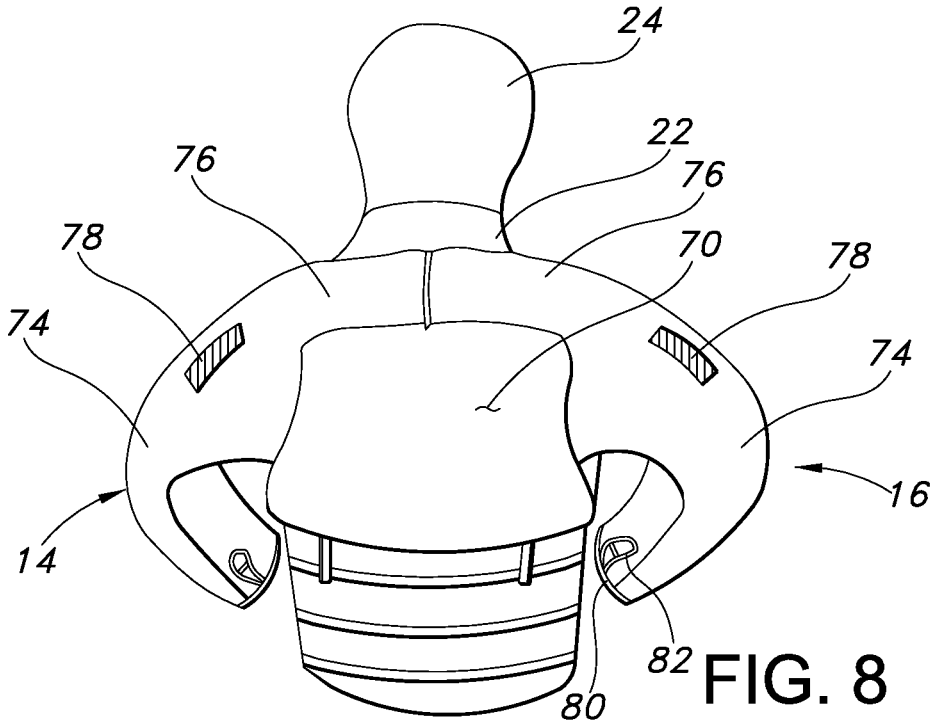
FIG. 8 is a rear plan view of the stowable half jacket of FIG. 1 joined to a load-bearing vest.

As shown in FIG. 4, the stowable jacket 10 can be folded and inserted into the pouch 48 formed between the upper and lower panels 50, 52. In this folded configuration, the jacket 10 can be stored in a rectangular, pillow-like shape. When a wearer desires to wear the stowable jacket 10, the jacket may be deployed from the integral pouch 48 and donned as though it were of a conventional construction, having an outward appearance of a jacket from the sternum up. The wearer can then secure the individual fasteners 66 to suitable portions of a load-bearing article 100, and tension the elastic band 60 to draw the stowable jacket 10 close to the wearer's torso and close to the load bearing article 100. In this configuration, the elastic band 60 can provide the jacket with extra snugness about the wearer's torso while also reducing the likelihood the jacket will rise up in a strong wind. When it is desired to return the jacket 10 to a stowed position, the fasteners 60 can be disengaged from the load bearing article 100, removed from the wearer and returned to a folded configuration in the integral pouch 48.

The stowable jacket 10 may be made of any suitable material, including for example a waterproof nylon or other synthetic material generally impermeable to water or snow, while also providing protection from blowing sand and dust. As alternatively illustrated in FIGS. 5-8, the stowable jacket 10 can include truncated left and right front panels 40, 42 bifurcated by a generally vertical opening 36 and zipper 38 or other suitable closure. The truncated left and right front panels 40, 42 can include an outer shell and an inner layer generally overlain by the outer shell for containing an insulating material therebetween. The stowable jacket 10 can include a back panel 70 opposite the left and right front panels 40, 42. In the present embodiment, the back panel 70 is generally lightweight and formed of nylon or other synthetic material being free from insulating layers. In other embodiments, however, the back panel 70 can include an outer shell and an inner layer generally overlain by the outer shell for containing an insulating material therebetween. The left and right sleeves 14, 16 can each include a front sleeve panel 72 and a rear sleeve panel 74. The rear sleeve panels can include yoke portions 76 that are stitched together between the back panel 70 and the collar 22. In addition, the rear sleeve panels 74 can include hook and loop strips 78 for attachment to equipment, insignia or other items. The left and right sleeves 14, 16 can include an outer shell and an inner layer generally overlain by the outer shell for containing an insulating material therebetween. The sleeves 14, 16 can terminate at respective hand openings including elastic cuffs 80 and optional elastic eyelets 82.

In the illustrated embodiment, the torso portion 12 terminates in an opening 20 generally at or above the wearer's abdomen. In other embodiments, only a portion of the opening 20 is at or above the wearer's abdomen. For example, the back portion 30 can extend downwardly beyond the front portion 28, such that the torso opening 20 is angled, stepped or oblong when viewed from the side. In addition, the torso portion 20 can define an upper torso portion, and the stowable jacket 10 can include a lower torso portion that is partially or completely separable from the upper torso portion. The lower torso portion, for example an abdominal panel, can extend partially or completely around the wearer's abdomen and upper pelvic region, and can include a lower periphery extending below the wearer's waist. The lower torso portion will generally include one or more fasteners, such as hook and look connectors, a zipper and/or snap connectors, to detachably secure the lower torso portion to the upper torso portion. Once removed, the lower torso portion can be reattached to the upper torso portion. In this regard, the stowable jacket 10 can be readily converted to a full-length jacket, optionally over a load-bearing vest and/or other equipment and clothing. In some embodiments, the lower torso portion will include a closure that functions as an extension of the torso portion closure 38.

To reiterate, the truncated torso portion 12 defines a lower circumferential edge 20 including one or more fasteners 68 to removably engage an upper portion of a separate article of wear 100. The separate article 100 can include load-bearing equipment such as an utility vest, a chest rig or a chest harness, for example. In the illustrated embodiment, the stowable jacket 10 is worn with a Modular Lightweight Load-carrying Equipment (MOLLE) vest 100. Depending on the needs of the wearer, the separate article 100 may or may not include ballistic body armor. When the jacket 10 is worn as shown in FIG. 3, the wearer can retain access to equipment on the MOLLE vest 100. The jacket 10 can therefore provide an added degree of protection from the elements while permitting unobstructed access to radios, ammunition and additional equipment supported by the MOLLE vest 100. When additional protection is no longer needed, the wearer can quickly remove the stowable jacket 10 by slackening the elastic band 60 and releasing the fasteners 68 from the MOLLE vest 100. The stowable jacket 10 can be reverse folded in the pouch 48 to form a generally rectangular, pillow-like shape for easy storage in the wearer's rucksack or cargo pocket.

The above descriptions are those of the current embodiments of the invention. Various alterations and changes can be made without departing from the spirit and broader aspects of the invention as defined in the appended claims, which are to be interpreted in accordance with the principles of patent law including the doctrine of equivalents. Any reference to elements in the singular, for example, using the articles "a," "an," "the," or "said," is not to be construed as limiting the element to the singular.

The invention claimed is:

1. An outerwear garment for use with a load-bearing vest, the outerwear garment comprising:

a torso portion including a front portion and a rear portion, the torso portion defining an upper neck opening and a lower body opening, the lower body opening defining a front periphery edge and a rear periphery edge;

wherein the front portion includes a left front portion and a right front portion, both the left front portion and the right front portion are adapted to extend downwardly from the wearer's neck and shoulders to the front periphery edge, the front periphery edge adapted to be located above the wearer's navel, a zipper that extends from the upper neck opening to the lower body opening, the zipper including a first portion connected to the front left portion and a second portion connected to the front right portion;

a system for securing the garment to a load bearing vest, the system including an elastic band and a plurality of fasteners supported by the elastic band for attachment to the load-bearing vest located adjacent the front and rear periphery edges, the elastic band extending through an anchor, wherein the anchor is adapted to retain a selected tension in the elastic band, wherein the front and rear periphery edges are cinchable at or above the load-bearing vest with adjustment of the anchor when worn by a user;

wherein the system for securing the garment to a load bearing vest need not be engaged in order for the garment to be donned.

2. The outerwear garment of claim 1 wherein the elastic band is adapted to bring the lower periphery into registration with one of the wearer's torso and the load-bearing vest.

3. The outerwear garment of claim 1 wherein the torso portion includes an inner surface and an outer surface, the inner surface including a pocket for storing the outerwear garment in a folded condition.

4. An upper body garment comprising:

left and right sleeve portions; and a torso portion coupled to the left and right sleeve portions and terminating at a lower periphery, the torso portion adapted to extend downward from the wearer's shoulders down over the wearer's pectorals and terminating above the wearer's navel at least in a front portion of the garment, a closing system located at the front of the garment for directly connecting and disconnecting a left portion of the garment with a right portion of the garment to facilitate donning and doffing;

a load bearing vest interface including an elastic band and a plurality of fasteners supported by the elastic band to detachably secure the garment to a load-bearing vest when worn by a user, the elastic band extending through an anchor, wherein the anchor is adapted to retain a selected tension in the elastic band, and wherein the elastic band is cinchable with adjustment of the anchor to bring the lower periphery into registration with the load-bearing vest.

5. The upper body garment of claim 4 wherein the torso portion includes an inner surface and an outer surface, the inner surface including a pocket for storing the upper body garment in a folded condition.

6. The upper body garment of claim 5 wherein the pocket includes first and second partially overlapping panels supported by the torso portion.

7. The upper body garment of claim 4 wherein the elastic band extends about the lower periphery.

8. The upper body garment of claim 4 wherein the elastic band includes a second anchor for tensioning the elastic band.

9. The upper body garment of claim 4 wherein the torso portion includes a generally vertically extending opening allowing donning and doffing of the garment.

10. The upper body garment of claim 4 wherein the left and right sleeve portions include an outer shell and an inner layer generally overlain by the outer shell.

11. A garment for wear with a utility vest, comprising:

a torso portion including a lower periphery adapted to extending about a wearer's torso, the lower periphery edge in a front portion of the garment being adapted to be located above the wearer's navel and below the wearer's pectorals;

the torso portion including a left side and a right side that connect and disconnect from each other for donning and doffing;

a system for connecting the lower periphery edge to a utility vest including:

a cinchable elastic band at the lower periphery of the torso portion, the cinchable elastic band extending through an anchor for tensioning and slackening the elastic band; and a plurality of fasteners supported by the cinchable elastic band for attachment to the utility vest, wherein the elastic band is cinchable with adjustment of the anchor relative to the elastic band to bring the lower periphery of the torso portion into registration with the utility vest.

12. The garment of claim 11 wherein the elastic band extends about the wearer's torso.

13. The garment of claim 11 wherein the height of the lower periphery varies as it extends around the wearer's torso.

14. The garment of claim 11 further including a pouch formed on an interior side of the back portion, wherein the garment may be deployed from the pouch for use as outerwear and inserted into the pocket in a stored condition.

15. The garment of claim 11, wherein at least some of the plurality of fasteners are located in the front portion of the garment and some of the plurality of fasters are located at a rear portion of the garment to facilitate securement of the garment to the utility vest.

* * * * *